US012263990B2

(12) United States Patent
West et al.

(10) Patent No.: US 12,263,990 B2
(45) Date of Patent: Apr. 1, 2025

(54) SECURING SYSTEM FOR STACKING CONTAINERS

(71) Applicant: Radius Outfitters INC., Monterey, CA (US)

(72) Inventors: Cody West, Carmel Valley, CA (US); Asa Engstrom, Monterey, CA (US)

(73) Assignee: RADIUS OUTFITTERS INC., Monterey, CA (US)

( * ) Notice: Subject to any disclaimer, the term of this patent is extended or adjusted under 35 U.S.C. 154(b) by 837 days.

(21) Appl. No.: 17/300,688

(22) Filed: Sep. 29, 2021

(65) Prior Publication Data

US 2023/0098690 A1 Mar. 30, 2023

(51) Int. Cl.
*B65D 21/00* (2006.01)
*B65D 21/02* (2006.01)

(52) U.S. Cl.
CPC ..... *B65D 21/0212* (2013.01); *B65D 21/0204* (2013.01); *B65D 21/0215* (2013.01)

(58) Field of Classification Search
CPC ..... B65D 21/0212; B65D 21/0204; B65D 21/0215
See application file for complete search history.

(56) References Cited

U.S. PATENT DOCUMENTS 1,656,161 A * 1/1928 Berndt ..... B65D 9/34 217/69
4,779,751 A * 10/1988 Munroe ..... B65D 21/0215 217/69
5,531,326 A * 7/1996 Hummel ..... B65D 5/006 220/640
5,617,967 A * 4/1997 Neidhart ..... B65D 19/40 220/636
2006/0119060 A1* 6/2006 Sullivan ..... B65D 21/0212 280/79.11
2020/0055631 A1* 2/2020 Combs ..... B65D 21/0215
2021/0245922 A1* 8/2021 Martínez Layseca ..... B65D 21/0215
2022/0402651 A1* 12/2022 Argetsinger ..... B65D 21/0215

* cited by examiner

*Primary Examiner* — Steven O Douglas
(74) *Attorney, Agent, or Firm* — James A. Garney, Jr.; JAG Patent Services

(57) ABSTRACT

A system for securing containers together includes posts, legs or support features that protrude from a panel of a first container and that fit into matched apertures on an adjacent panel of a second container. The posts, legs or support features are secured within or through the matched apertures or within matched apertures on interlock blocks that are on or attached to the adjacent panel of a second container through braces, brackets, clamps and pins (magnet or spring loaded) that engage the posts, legs or support features.

6 Claims, 4 Drawing Sheets

SECURING SYSTEM FOR STACKING CONTAINERS

FIELD OF THE INVENTION

The present invention relates to containers. More specifically, this invention relates systems for securely stacking containers.

BACKGROUND OF THE INVENTION

Containers are often stacked on top of one and other. Stacked container can be stabilized during shipping or transporting using braces, straps or tie-downs and the like. Sometimes stacked containers are nailed or screwed together to provide the required stability to transport them over long distances.

SUMMARY OF THE INVENTION

The present invention is directed to a container stacking and securing system. The securing system is described herein in terms of a top container and a bottom container that are placed in a stacked position. But it will be clear to one skilled in the art that the securing system can be used to secure any number of containers together through any set of adjacent container panels including container side panels.

In accordance with the embodiments of the invention the securing system includes an interlock mechanism fits together to secure a bottom container and a top container (also referred to herein as a first container and a second container) together in a stacked position. The interlock mechanism includes, for example, posts, legs or support features that protrude from the outer bottom surface of a bottom panel of the top container and/or outer top surfaces of a top panel of the bottom container. In operation, the posts, legs or support features fit into matched or fitted apertures that are on or that pass through the other of the bottom panel of the top container and/or the top panel of the bottom container when the bottom container and the top container are placed a the stacked position, The posts, legs or support features are formed from any suitable material including, but not limited to, metal, wood, plastics or polymers, composite materials and combinations thereof.

In accordance with the embodiments of the invention the posts, legs or support features all protrude from the outer bottom surfaces of a bottom panel of the top container and fit into matched or fitted apertures that are on or that pass through a top panel of the bottom container with the bottom container and the top container in the stacked position. In this embodiment, the posts, legs or support features can provide a level support for the top container when the top container is removed from the top panel of the bottom container and placed on a different support surface.

With the bottom container and the top container in the stacked position and with the posts, legs or support features in the positions, as described above, the posts, legs or support features are locked into the fitted or matched apertures by, for example, braces, brackets, clamps and pins (magnet or spring loaded) that engage portions of the posts, legs or support features within the fitted or matched apertures or engage portions of the posts, legs or support features that pass through the top panel of the bottom container.

In accordance with the embodiments of the invention the securing system include a pin locking mechanism. The pin locking mechanism includes a pin channel that passes through a side edge of a container panel or interlock block, such as described below and passes into a portion of a matched aperture or second matched aperture. The posts, legs or support features are preferably substantially cylindrical with a grooved locking channel or aperture that engages a securing pin that passes over a grooved locking channel or aperture on portions of the posts, legs or support features with the top container and the bottom container in the stacked position.

In further embodiments of the invention, the interlocking mechanism of the securing system further includes interlock blocks that have matched apertures for receiving posts, legs or support features. In accordance with one embodiment of the invention, interlock blocks have a second set of matched apertures that are place against an interior upper surface of the top panel of the bottom container with the second set of matched apertures eclipsing a first set of matched apertures that pass through the top panel of the bottom container. Posts, legs or support features that protrude from the outer surface of the bottom panel of the top box are passed through the first set of matched apertures on the top panel of the bottom container and into the second set of matched the apertures on the interlock blocks. The posts, legs or support features are then secured within the second set of matched apertures using a securing pin mechanism or any other suitable securing mechanism, thereby securing the top container and the bottom container in the stacked position.

In further yet embodiments of the invention, interlock blocks fit into cut-outs on edges of the top panel of the bottom container and/or cut outs of edges of the bottom panel of the top container. The interlock blocks in accordance with this embodiment have tongue and grove features, dove tail features and any other suitable fitted features allow the interlock blocks to fit into matched tongue and grove features, dove tail features and/or of the fitted features on internal edges of the cut-outs on the container panels, such that the interlock blocks are secured within the cut-outs on the container panels. The interlock blocks include matched apertures to receive the posts, legs or support features. In operation the interlock blocks are fitted into the cut-outs and secured therein and the posts, legs or support features that protrude from a bottom panel of the top container, the top panel of the bottom container, or a combination thereof, are positioned through or into the matched apertures on interlock blocks. The posts, legs or support features are then secured into the matched apertures of the interlock blocks with the top container and the bottom container in a stacked position using braces, brackets, clamps, pins or combinations thereof.

DETAILED DESCRIPTION OF THE INVENTION

Figure 1A:
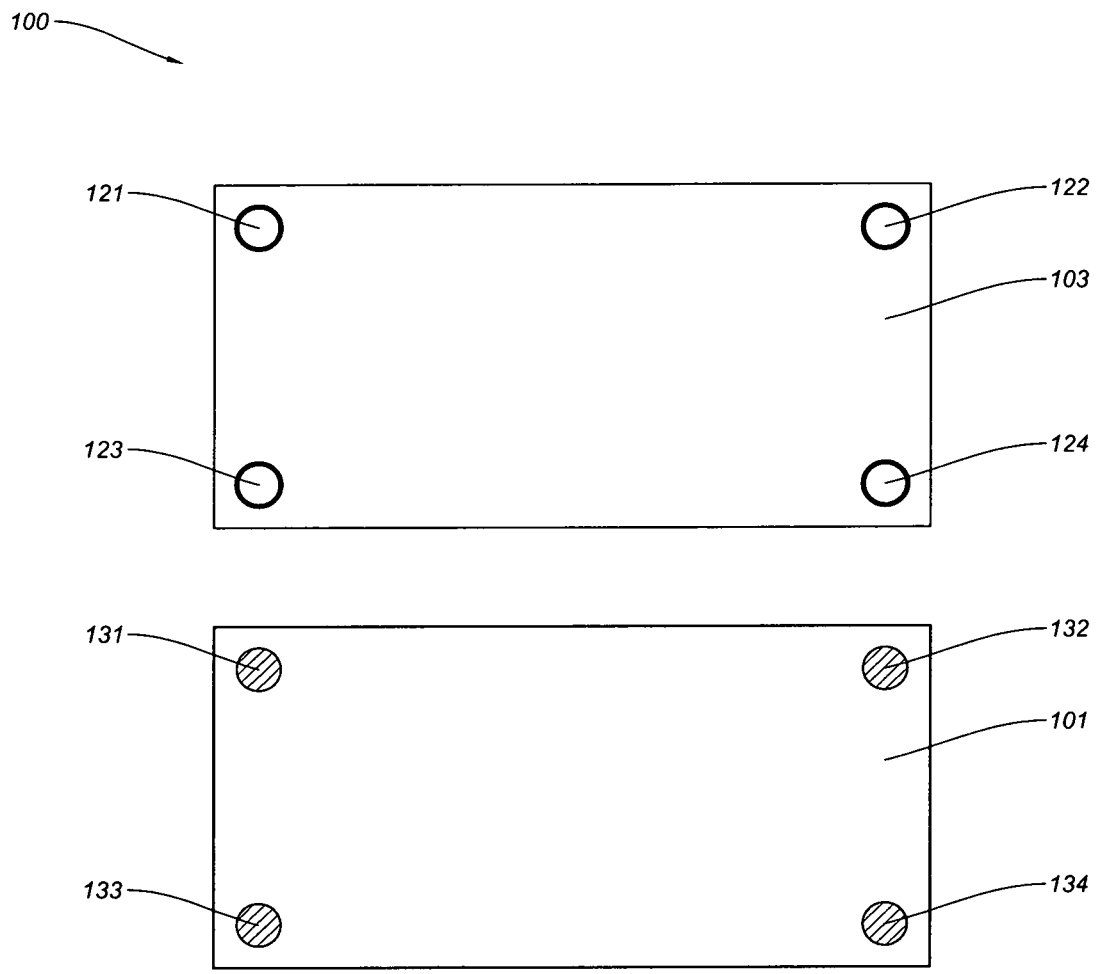
FIGS. 1A-B show schematic representations of a securing system for securing containers together, in accordance with the embodiments of the invention.
Figure 1B:
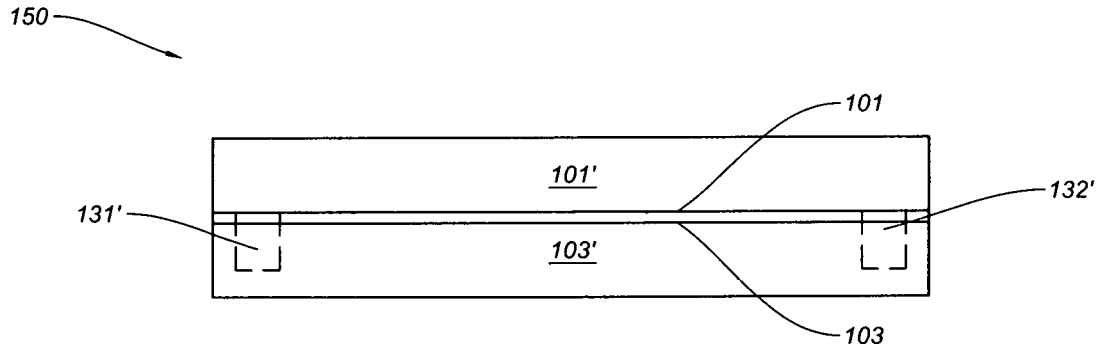

FIGS. 1A-B show schematic representations of a securing system for securing containers 101' and 103' and together. In accordance with the embodiments of the invention the securing system includes an interlock mechanism to secure a bottom container 103' and top container together 101' in a stacked position 150. The interlock mechanism includes, for example, posts, legs or support features 131, 132, 133 and 134 that protrude from the outer bottom surface of a bottom panel 101 of the top container 101'. The posts, legs or support features 131, 132, 133 and 134 fit into matched or fitted apertures 121, 122, 123 and 124 that are on or that pass through the top panel 103 of the bottom container 103' when the bottom container 103' and the top container 101' are placed in the stacked position 150. The posts, legs or support features 131, 132, 133 and 134 are formed from any suitable material including, but not limited to, metal, wood, plastics or polymers, composite materials and combinations thereof.

While the invention is described herein as being for securing containers together in a stacked position 150, it will be clear to one skilled in the art that the securing system, of the present invention can be used to attached containers together through any adjacently positioned container panels, walls or surfaces, such as side container panels. Containers that are secured together through the system of the present invention do not need to be the same size or have the same shape. Portions of the posts, legs or support features 131, 132, 133 and 134 and portions of the matched or fitted apertures 121, 122, 123 and 124 can be located on both the top panel 101 and the bottom panel 103 as long as there is a paired post, leg or support feature and matched aperture that align with each other when the containers are mated together or stacked. Also, while paired posts, legs or support features 131, 132, 133 and 134 and matched apertures 121, 122, 123 and 124 are shown to be positioned at or near corners of the container panels 101 and 103, the posts, legs or support features 131, 132, 133 and 134 and matched apertures 121, 122, 123 and 124 can be located at any number of different locations on adjacently positioned container panels, walls or surfaces to secure containers together.

In the embodiment shown the posts, legs or support features 131, 132, 133 and 134 are on the same panel 101 and the posts, legs or support features 131, 132, 133 and 134 can provide a level support for the top container 101' when the top container 101' is removed from the stacked position 150 on the top panel 103 of the bottom container 103' and placed on a different support surface, such as a floor of shelf.

With the bottom container 103' and the top container 101' are in the stacked position 150 and with the posts, legs or support features 131, 132, 133 and 134 placed in the matched apertures 121, 122, 123 and 124, the posts, legs or support features 131, 132, 133 and 134 are locked into the matched apertures 121, 122, 123 and 124 by, for example, braces, brackets, clamps and pins (magnet or spring loaded) features that engage and secure portions of the posts, legs or support features 131' and 132' within portions the matched apertures 121, 122, 123 and 124.

Figure 2:
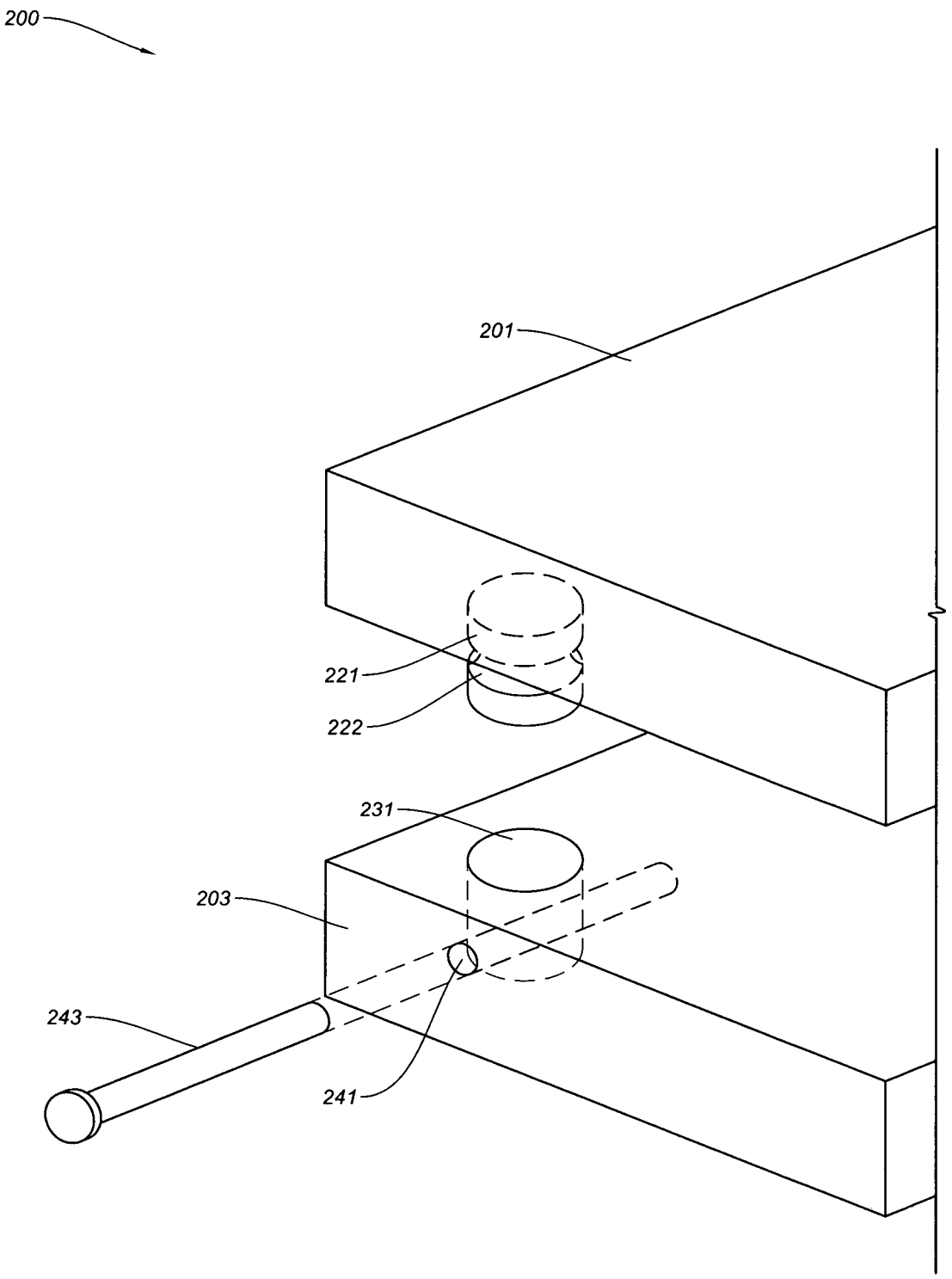
FIG. 2 shows a perspective view of a system for securing containers together that includes a securing pin mechanism for holding posts, legs or support features within matched apertures, in accordance with the embodiments of the invention.

FIG. 2 shows a perspective view of a system 200 for securing containers together that includes securing pin mechanism 241/243 for holding posts, legs or support features 221 (such as the posts, legs or support features 131, 132, 133 and 134) within matched apertures 231 (such as the matched apertures 121, 122, 123 and 124), in accordance with the embodiments of the invention.

In accordance with this embodiments of the invention, the posts, legs or support features 221 are attached to a bottom panel 201 of a top container 101' (FIG. 1B) and are substantially cylindrical with a grooved locking channels 222 that encircles the posts, legs or support features 221. The pin securing mechanism 241/243 includes a locking pin aperture or channel 241 that passes into a top panel 203 of a bottom container 103' (FIG. 1B). In operation the posts, legs or support features 221 are placed into the matched apertures 231, the pin 243 is placed into the locking pin aperture or channel 241 and the pin 243 engages the grooved locking channels 222 on the posts, legs or support features 221, thereby securing the posts, legs or support features 221 within the matched apertures 231 and, thereby, securing the top container 101' and the bottom container 103' in the stacked position 150 (FIG. 1B). Alternatively, a locking pin aperture or channel 241 can pass into or through the posts, legs or support features 221 to the same effect.

Figure 3:
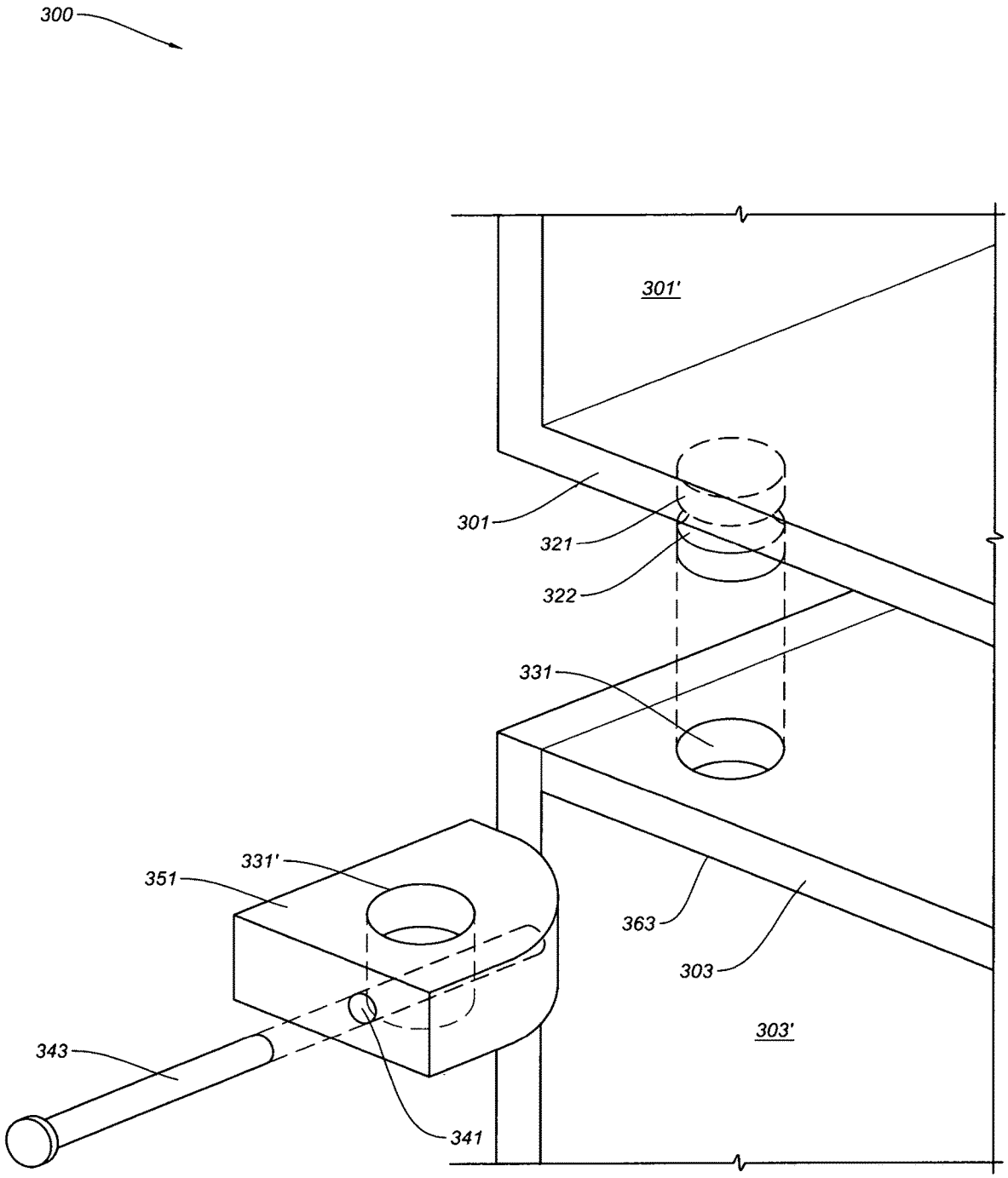
FIG. 3 show a perspective view of a system for securing containers together that interlock blocks that include a second set of matched apertures for receiving posts, legs or support features, in accordance with the embodiments of the invention.

FIG. 3 show a perspective view of a system 300 for securing containers together that includes a interlock block mechanism 351/341/343. The interlock block mechanism 351/341/343 includes interlock blocks 351 and pin securing mechanism 341/343. The interlock blocks 351 have a second set of matched apertures 331' for receiving portions of posts, legs or support features 321, while the top panel 303 of a bottom container 303' has a first set of matched apertures 331 that the posts, legs or support features 321 pass through, when the bottom container 303' and a top container 301' are placed in a stacked position 150 (FIG. 1B). In accordance with the embodiments of the invention, the posts, legs or support features 321 are attached to a bottom panel 301 of the top container 301' and are substantially cylindrical with a grooved locking channels 322 that encircle the posts, legs or support features 321. The interlock blocks 351 and pin securing mechanism 341/343 includes a locking pin aperture or channel 341 that passes into side walls of the interlock blocks 351. In operation the interlock blocks 351 are placed against an inner bottom surface 363 of the top panel 303 of the bottom container 303' and with the first set of matched apertures 331 on the top panel 303 of the bottom container 303' eclipsing the second set of matched apertures 331' on the interlock blocks 351, the posts, legs or support features 321 are placed through the first set matched apertures 331 and into the second set of matched apertures 331'. The pin 343 is then pushed into the locking pin aperture or channel 341 and the pin 343 engages the grooved locking channels 322 on the posts, legs or support features 321, thereby securing the posts, legs or support features 321 within the second set matched apertures 331' and, thereby, securing the top container 101' and the bottom container 103' together in the stacked position 150 (FIG. 1B). Again, the locking pin aperture or channel 341 can also pass into or through the posts, legs or support features 321 to the same effect.

Figure 4:
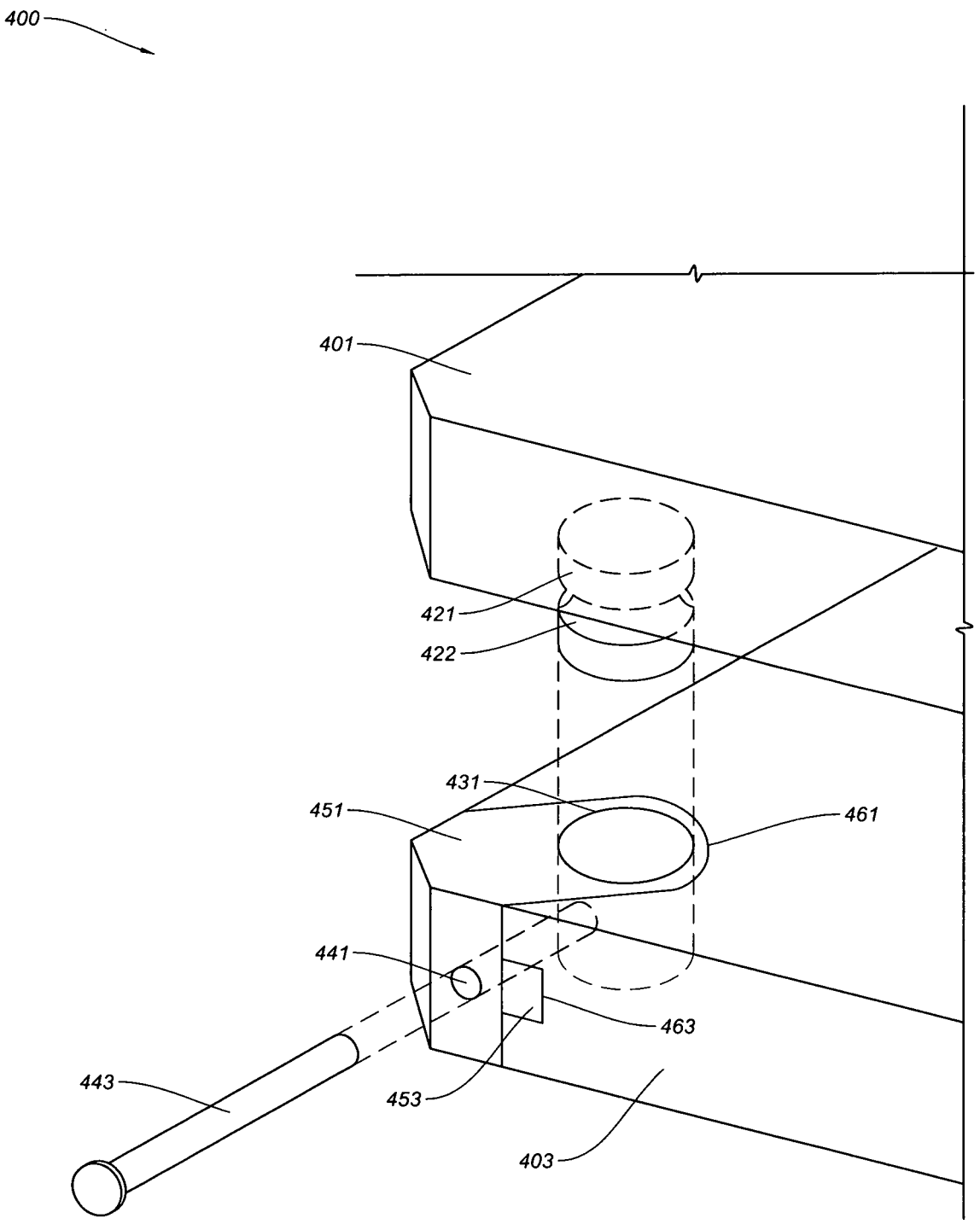
FIG. 4 show a perspective view of a system for securing containers together that include interlock blocks that fit into panel cut outs on the containers and include matched apertures for receiving posts, legs or support features, in accordance with the embodiments of the invention.

FIG. 4 show a perspective view of a system 400 for securing containers together that includes a interlock block mechanism 451/441/443. The interlock block mechanism 451/441/443 includes interlock blocks 451 and a pin securing mechanism 441/443. The interlock blocks 451 have matched apertures 431 for receiving portions of posts, legs or support features 421. The interlock blocks 451 fit into cut-outs 461 of edges of the top container panel 403 of a bottom container and/or cut outs of edges of a bottom container panel 401 of top container. The interlock blocks 451 in accordance with this embodiment have tongue and grove features, dove tail features and any other suitable fitted features 453 that allow the interlock blocks 451 to fitted into matched tongue and grove features, dove tail features and/or fitted features 463 on interior edges of the cut-outs 461 on the bottom container panel 403, such that the interlock blocks are secured within the cut-outs 461 on the bottom container panel 403. The posts, legs or support features 421 are preferably attached to a top container panel 401 and are substantially cylindrical with a grooved locking channels 422 that encircles the posts, legs or support features 421. The interlock blocks 451 and pin securing mechanisms 441/443 include locking pin apertures or channels 441 that passes into a side wall of the interlock blocks 451. In operation the interlock blocks 451 are fitted into the cut-outs 461 and secured therein. The posts, legs or support features 421 that are attached to the bottom container panel 401 are then placed into matched apertures 431 on the interlock blocks 451. Then the locking pins 443 are placed into the locking pin aperture or channels 441 and the locking pins 443 engages the grooved locking channels 422 on the posts, legs or support features 421, thereby securing the posts, legs or support features 421 within the matched apertures 431 and, thereby, securing the top container 101' and the bottom container 103' in the stacked position 150 (FIG. 2B). Again, the locking pin aperture or channel 441 can also pass into or through the posts, legs or support features 421 to the same effect.

The interlock blocks 351 (FIG. 3) and 451 (FIG. 4) can have any number of different shapes and the locking pin aperture or channels 341 (FIG. 3) and 441 (FIG. 4) can pass through the interlock blocks 351 and 451 any number of different angles suitable for the application at hand and to allow easy access for inserting and removing the locking pins 343 (FIG. 3) and 443 (FIG. 4).

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A system for securing containers together comprising:

a) posts, legs or support features that protrude from a panel of a first container;

b) matched apertures on an adjacent panel of a second container, wherein the posts, legs or support features fit through or into the matched apertures; and c) a securing mechanism for securing portions of the posts, legs or support features within the matched apertures with the first container and the second container in a stacked position, wherein securing mechanism includes locking pins that engage grooved locking channels that encircle the posts, legs or support features with the posts, legs or support features positioned within the matched apertures.

2. The system of claim 1, wherein the posts, legs or support features are substantially cylindrical.

3. A system for securing containers together comprising:

a) posts, legs or support features that protrude from a panel of a first container;

b) a first set of matched apertures on an adjacent panel of a second container, wherein the posts, legs or support features fit through the matched apertures; and c) a securing mechanism that comprises interlock blocks with a second set of matched apertures that are placed against a bottom interior surface of the adjacent panel of the second container with the first set of matched apertures and the second set matched apertures eclipsed and locking pins that engages the posts, legs or support features with the posts, legs or support features passing through the first set of matched aperture and within the second set of matched apertures with the first container and the second container in a stacked position.

4. The system of claim 3, wherein the interlock blocks have locking pin apertures or channels that passes into side walls of the interlock blocks and receive the locking pins that engage grooved locking channels on the posts, legs or support features.

5. A system for securing containers together comprising:

a) posts, legs or support features that protrude from a panel of a first container; and b) a securing mechanism that comprises interlock blocks with set of matched apertures that fit into cutouts on side surfaces of an adjacent panel of a second container and locking pins that engage the posts, legs or support features with the posts, legs or support features within the set of matched apertures on the interlock blocks with the first container and the second container in a stacked position wherein the interlock blocks are secured within the cut-outs on the side edges of the adjacent panel through the tongue and grove or dove tail features on the interlock blocks and matched tongue and grove or dove tail features on interior edges of the cut-outs.

6. The system of claim 5, wherein the interlock blocks have locking pin apertures or channels that passes into a side wall of the interlock blocks and receive the locking pins and engage a grooved locking channels on the posts, legs or support features.

* * * * *